US005522332A

United States Patent [19]

Price et al.

[11] Patent Number: 5,522,332

[45] Date of Patent: Jun. 4, 1996

[54] WAIST BAND ATTACHMENT SYSTEM

[75] Inventors: Elvin C. Price, Dacula; Preston B. Dasher, Lawrenceville; Gerald C. Valentine, Buford, all of Ga.

[73] Assignee: Atlanta Attachment Company, Lawrenceville, Ga.

[21] Appl. No.: 311,921

[22] Filed: Sep. 26, 1994

Related U.S. Application Data

[63] Continuation-in-part of Ser. No. 131,131, Oct. 4, 1993.

[51] Int. Cl.[6] ..... D05B 21/00

[52] U.S. Cl. ..... 112/470.29; 112/470.31; 112/DIG. 2; 112/306

[58] Field of Search ..... 112/470.31, 470.29, 112/152, 153, DIG. 2, 305, 63, 322, DIG. 3, 475.07, 475.09, 306; 139/291 R, 292; 26/98, DIG. 1

[56] References Cited

U.S. PATENT DOCUMENTS

| | | | |
|---|---|---|---|
| 4,046,087 | 9/1977 | Manetti . | |
| 4,053,967 | 10/1977 | Mair | 26/98 |
| 4,265,187 | 5/1981 | Torre . | |
| 4,473,017 | 9/1984 | Letard et al. . | |
| 4,484,532 | 11/1984 | Norz . | |
| 4,928,610 | 5/1990 | Akutsu | 112/151 X |
| 5,269,239 | 12/1993 | Adamski, Jr. et al. | 112/63 X |
| 5,269,257 | 12/1993 | Yamazaki | 112/306 X |

FOREIGN PATENT DOCUMENTS 58-11471 1/1983 Japan .

*Primary Examiner*—Paul C. Lewis
*Attorney, Agent, or Firm*—Hopkins & Thomas

[57] ABSTRACT

The waist band (16) is placed in straddling relationship about spindles (12–15). The waist edge (23) of the shirt body (17) is telescoped about the waist band, also in straddling relationship about the spindles (12–15). The garment parts are advanced by the rotation of the spindles and the sewing needle (9) forms a line of stitching at the aligned edges of the shirt body and waist band. In the meantime, the end spindles (14 and 15) move laterally of the sewing path to adjust the position of the waist band in response to the position of the folded edge (21) of the waist band as detected by photocell (30/138), and the star wheels (32) (FIGS. 5–7) reach across the waist band and urge the shirt body toward or away from the sewing path as controlled by the photocell (31/208). When the previously sewn edges of the garment parts begin to return to the sewing machine, one of the spindles (15) moves laterally so as to stretch the garment parts mores so as to remove any bunching of the waist edge of the shirt body at the sewing needle and presser foot, to avoid forming a wrinkle in the shirt body at the end of the line of the stitching.

23 Claims, 10 Drawing Sheets

WAIST BAND ATTACHMENT SYSTEM

CROSS REFERENCE TO RELATED APPLICATION

This is a continuation-in-part of U.S. patent application Ser. No. 08/131,131 filed Oct. 4, 1993.

FIELD OF THE INVENTION

This invention relates to a method and apparatus for attaching a continuous loop waist band to the continuous waist edge of a tubular shirt body or to the continuous waist edge of slacks. The waist band material is attached to the waist edge of the garment by matching an edge of the waist band with the waist edge of the garment, stretching both garment parts to substantially the same breadth and advancing the matched edges through a sewing machine.

BACKGROUND OF THE INVENTION

In the production of garments in an industrial setting in which batches of garment parts are delivered to work stations where the garment parts are connected together, it is important that the equipment provided to the worker be fast and efficient in its operation, but also it is important that the garment parts can be expediently loaded on the equipment. Further, it is highly desirable that once the garment parts have been loaded in position and the equipment is placed in operation that the worker be able to momentarily leave the equipment while the equipment continues to operate. This enables the worker to operate more than one machine and to gather more garment parts and match them together for presentation to another duplicate machine for its next cycle of operation.

In the production of stretchable garments, such as sweat suits having a shirt body made of fleece and a waist band of stretchable knit material, it is sometimes difficult for the worker or the equipment to accurately control the material as it is being fed to the sewing machine. For example, when the knitted waist band of a sweat suit is to be connected to the waist edge of the fleece shirt body, the more stretchable waist band may be of smaller breadth than the waist edge of the shirt body when both garments are relaxed. When the waist band and the waist edge of the shirt body are being guided to the sewing machine, the waist band usually must be stretched more than the waist edge of the shirt body in order that they are properly matched in breadth as they are sewn together. Further, the edge of the fleece material usually tends to curl as it is stretched, which requires the curled edges to be flattened before they are presented to the sewing needle of the sewing machine. Also, some of the waist bands are cut to improper widths or are cut with non-uniform widths which, when sewn to the shirt body, etc., ultimately causes the garment to be unaccepted.

Because of these inherent problems in presenting the stretchable waist band and shirt body or pants body materials to the sewing needles of the sewing machine and operating the equipment, the machine operator is required to develop a relatively high skill in presenting the work product to the sewing machine, and the presentation of the work product to the sewing machine requires substantially full attention of the operator during at least some of the cycle of operation of the sewing machine. This results in the operator not having enough time during the cycle of operation of the sewing machine to retrieve and assemble the next garment parts that are to be presented to the sewing machine or to operate two machines simultaneously.

SUMMARY OF THE INVENTION

Briefly described, the present invention comprises a method and apparatus for matching the edge to be connected of a loop waist band and the waist edge of a shirt body or slacks, stretching the waist band and the waist edge until their breadths are matched, and advancing the matched edges along the sewing path of the sewing machine prior to sewing for a preliminary alignment run until the edges are automatically aligned in the sewing path of the sewing head and for removing any curl in the waist edge. Further, when the sewing cycle is almost completed, the waist band and shirt waist are further stretched to eliminate any tendency of the presser foot of the sewing machine to form a pleat or wrinkle in the waist edge at the end of the sewing cycle.

A set of rotatable guide spindles is mounted to the work table of the sewing machine and project out parallel to one another at the sewing machine toward the operator's position. The worker places the waist band in straddling relationship about the spindles, with an edge of the waist band positioned in the sewing path of the sewing machine. The waist edge of the shirt body is then telescopically mounted about the waist band, also in straddling relationship about the same guide spindles, with its edge matched with the edge of the waist band, in the sewing path. One of the spindles is then moved laterally so as to move away from the other spindles and therefore expand the waist band and waist edge of the shirt body, so that both the waist band and the waist edge of the shirt body are under tension and the lengths of the matched edges of the garment parts are substantially the same as they pass through the sewing machine.

At least some of the guide spindles which are used to guide the work product through the sewing machine have elongated, generally cylindrical bodies, each rounded at its distal end and including a radially extending flange at its base. The flange is approximately aligned with the sewing path through the needles of the sewing head, and the rounded end of the spindle extends away from the sewing path. The elongated body of the spindle has a tapered portion converging toward the flange, and an annular recess is formed in the body of the spindle at a position intermediate the rounded end and the tapered portion. This spindle configuration tends to hold the waist band and the waist edge of the garment firmly as the spindles are rotated and the garment parts are moved progressively into the sewing needles of the sewing machine. The converging tapered portion of the spindles tends to assure that the edges of the garment parts abut the flange of the spindle, thereby maintaining alignment of the matched edges of the garment parts in the sewing path.

A decurling assembly is placed in the upstream portion of the sewing path so as to remove curl in the edges of the garment parts as they approach the sewing machine. The garment parts are allowed to advance along the sewing path a distance sufficient to allow the decurled portions of the garment parts to pass from the decurling assembly to the sewing machine needles before the sewing machine is activated, thus assuring that the edges of the garment parts will be flattened before they are connected together. Later, the decurler retracts from the garment parts so that it is out of the way as the previously sewn matched edges of the garment parts return to the sewing needles.

In the meantime, the matched edges moving toward the sewing needles pass through an edge guide system that controls the positions of the edges of the garment parts as they advance to the sewing needles. The band edge is controlled by moving at least one of the spindles laterally with respect to the sewing path. Through the use of an electric eye and a reversible stepping motor combinations the waist edge is controlled by a pair of rotatable toothed star wheels that reach across the waist band and urge the shirt waist back and forth across the sewing path.

After the sewing cycle has been completed and the entire lengths of the edges of the waist band and shirt body have been properly sewn together, an ejector progressively pushes the matched and now sewn edges of the garment parts laterally out of the sewing path, so that a smooth transition is formed in the stitching as the sewing machine sews off the garment.

A stacker is positioned adjacent the spindles and provides a movable supply frame for supporting a supply of unfinished shirt bodies at the worker's station, and an accumulation frame for receiving the finished garment parts. A wiper bar flips the garment off the spindles and over the accumulation frame.

Therefore, it is an object of this invention to provide an improved method and apparatus for attaching an uninterrupted looped waist band to the waist edge of an approximately tubular body garment such as a tubular shirt body, in which the waist band and shirt body can be presented to the sewing machine by the worker, and the sewing function can commence and continue until completed while the worker is free to perform other functions.

Another object of this invention is to provide an improved waist band attachment system for a sewing machine which functions to automatically feed and decurl the matched edges of a waist band and the waist edge of a tubular shirt body of a sweat suit or similar garment made of stretchable materials as the garment parts move along the sewing path of the sewing machine.

Another object of this invention is to provide an improved set of guide spindles for maintaining the edges of stretchable garment parts in matched alignment while accurately guiding the matched edges of the garment parts along the sewing path of a sewing machine.

Another object of this invention is to provide a system for expediently and accurately loading stretchable garment parts in a sewing position at a sewing machine, and which functions to sew the garment parts together without requiring the attention of a sewing machine operator during the sewing function and to stack the finished garment parts.

Another object of this invention is to provide a garment support assembly mounted to the work table of a sewing machine which functions to support and guide garments during a sewing function, and which can be rapidly adjusted to accommodate different size garments, and which can be moved out of the way and replaced as may be necessary in repairing and maintaining the sewing machine.

Other objects, features and advantages of the present invention will become apparently upon reading the following specification, when taken in conjunction with the accompanying drawing.

DETAILED DESCRIPTION

Figure 1:
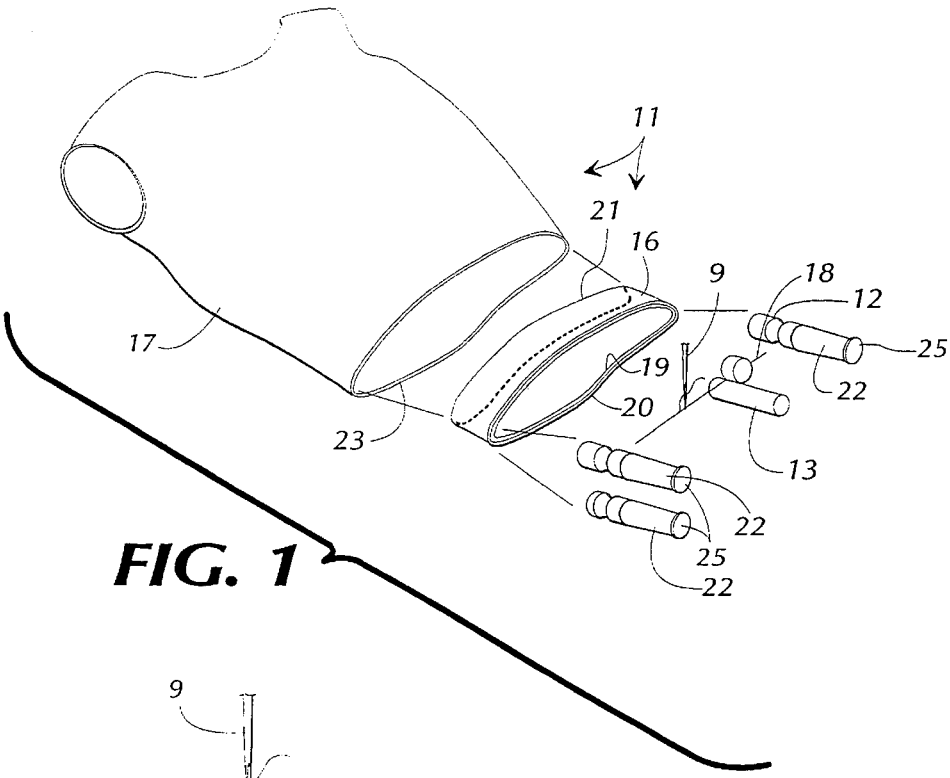
FIG. 1 is a perspective illustration of a tubular shirt body and a waist band of a garment prior to being connected together, illustrating how those parts of the garment would be placed in straddled relationship about the guide spindles of the system.
Figure 2:
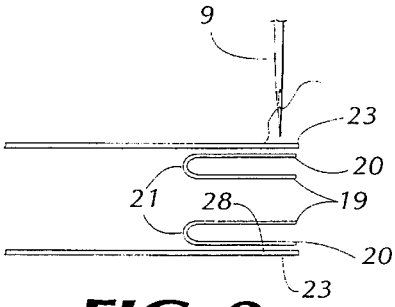
FIG. 2 is a schematic illustration of the waist band and shirt body showing how the waist band is folded and how the waist edge of the shirt body is aligned with the matched edges of the waist band.

Referring now in more detail to the drawings, in which like numerals indicate like parts throughout the several views, FIG. 1 is a perspective illustration of garment parts 11 which are to be placed in straddling relationship about spindles 12, 13, 14 and 15, at the sewing needle 9 of a sewing machine. The garment parts include a knitted continuous loop waist band 16 and a fleece shirt body 17. As shown in FIGS. 1 and 2, the knitted waist band is folded over along its length so that its edges 19 and 20 are in overlying aligned relationship. The edges are to be placed in the sewing path 18 which extends through the needle 9. The fold 21 of the waist band faces away from the sewing needle 9. The shirt body 17 has a waist edge 23 that is to be placed in overlying alignment with the edges 19 and 20 of the waist band, in the sewing path.

Figure 5:
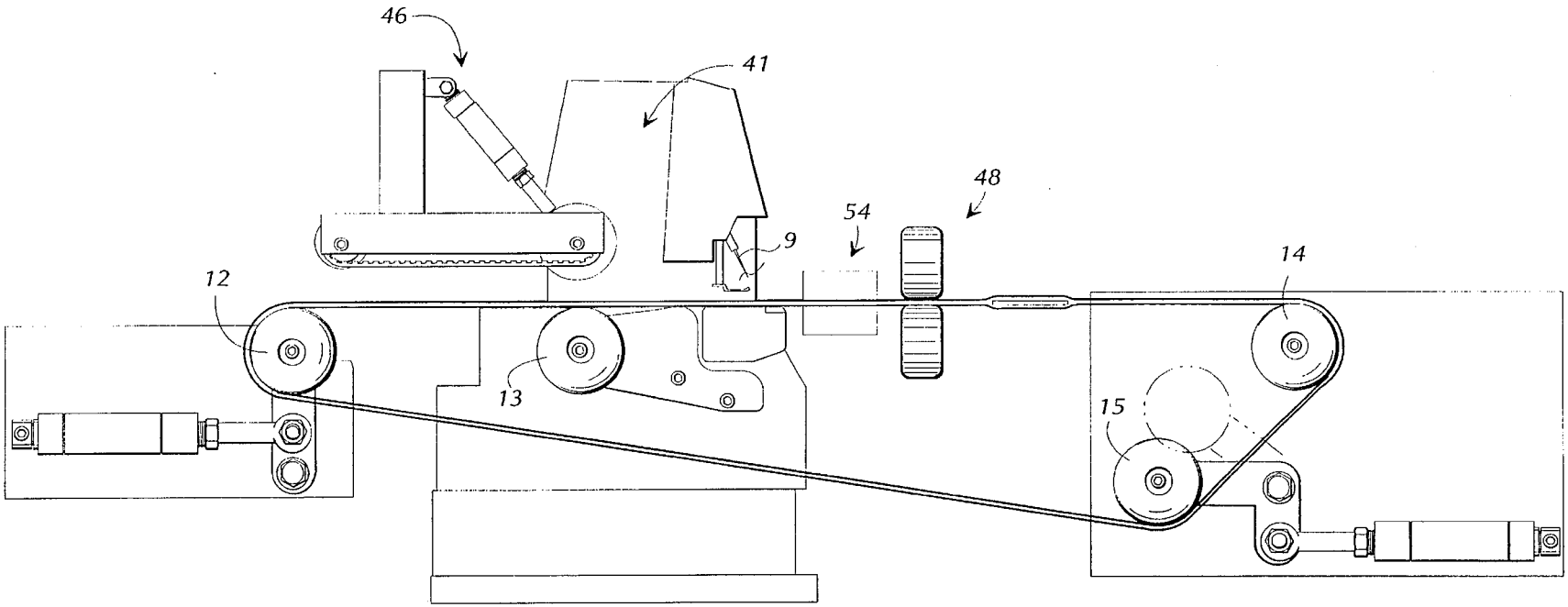
FIG. 5 is a front schematic illustration of the system of FIG. 4, showing how the guide spindles function to guide the garment parts through the sewing machine.

Typically, the sewing machine operator folds the waist band by hand and then stretches the waist band and places it about all of the spindles so that the waist band straddles all of the spindles 12–15 (FIG. 5). Spindles 12, 14 and 15 each are elongated with a rounded distal end, and has a base flange 25 which protrudes laterally from the body portion of the spindle, and an inwardly tapered segment 22 adjoining the base flange. The aligned edges 19 and 20 of the waist band are moved by the sewing machine operator to the tapered portion and into abutment with the base flanges. Spindle 13 is substantially cylindrical and has no flange or tapered segment.

Once the knitted waist band is inserted on the spindles, its natural elasticity causes it to cling about the spindles. The operator then places the waist edge 23 of the shirt body 17 in telescoped relationship about the waist band 16 until its waist edge also abuts the flanges 25 of the spindles. As shown in FIG. 2, the aligned edges 19, 20 and 23 are likely to be placed in the sewing path 18, in alignment with the sewing needle 9 of the sewing machine, depending on the accuracy of the placement by the operator.

Figure 3:
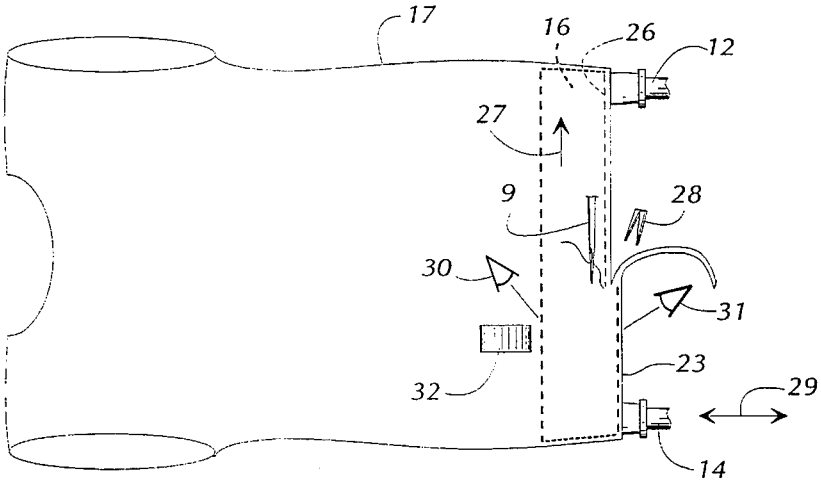
FIG. 3 is an illustration of the shirt body and the waist band, showing schematically how tile parts are guided and sewn together.

As illustrated in FIG. 3, the waist band 16 and shirt body 17 are moved in the direction indicated by arrow 27 about the spindles 12–15 and the sewing needle 9 forms stitches 26 at the aligned edges 19, 20 and 23 of the garment parts. A conventional trimmer 28 of the sewing head cuts the portion of the garment parts that overlie the sewing path away from the garment parts, thereby assuring neat and aligned edges of the connected garment parts. Further, and in a manner as explained more fully hereinafter, the spindle 14 will be reciprocated as indicated by arrow 29 in response to the detection by photo cell 30 of the folded edge 21 of the waist band, thereby guiding the waist band along the sewing path for stitching and trimming, and uniformly providing waist bands of a predetermined width. Further, the edge 23 of the shirt body is detected by photo cell 31 and guide star wheels 32 rotate to pull or push the shirt body across the sewing path, thereby aligning the waist edge of the shirt body with the sewing path.

Figure 4:
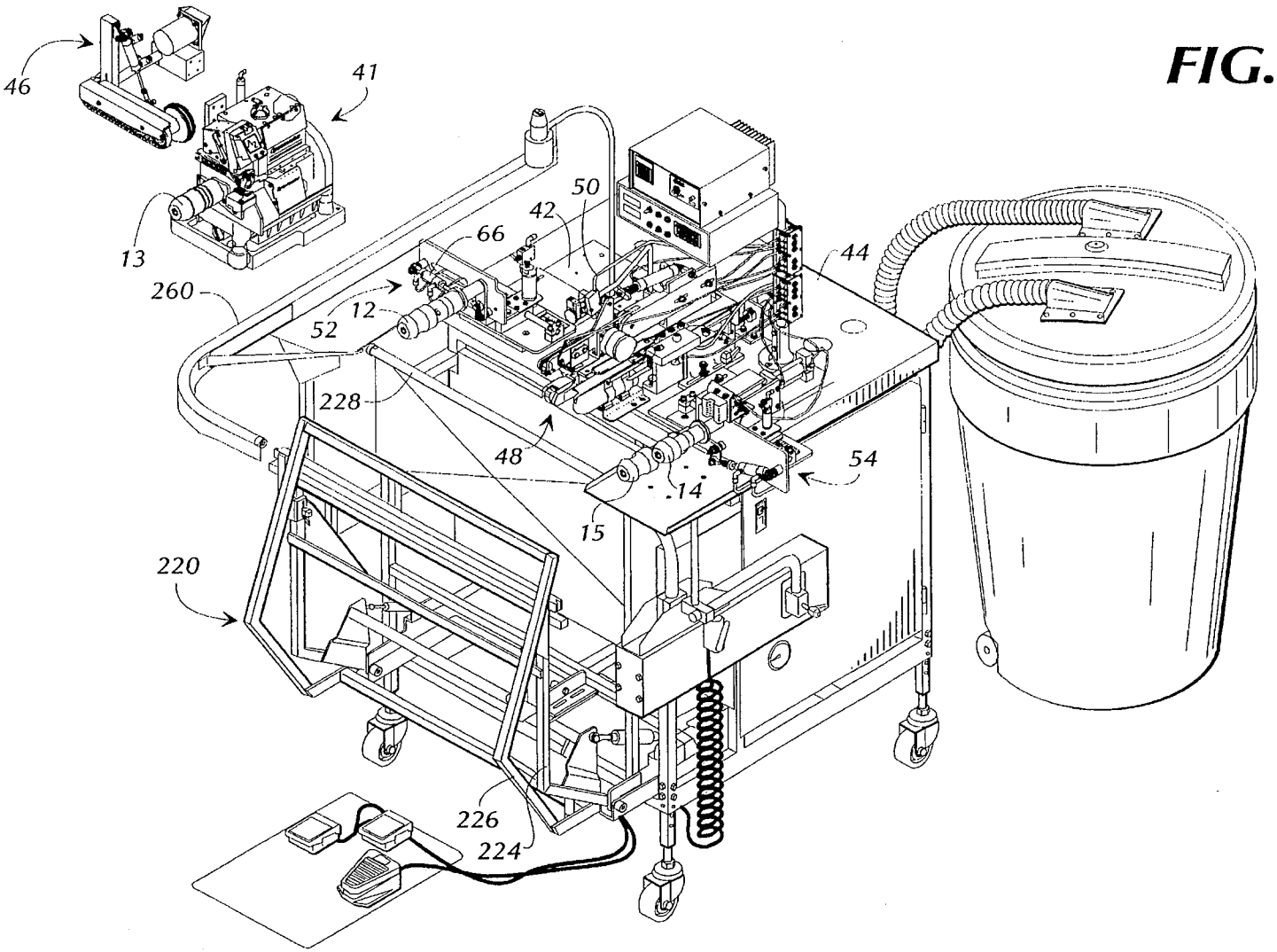
FIG. 4 is a perspective illustration of the waist band attachment system.

As generally illustrated in FIG. 4, wherein the operative components are shown for performing the functions illustrated in FIGS. 1–3, the shirt waist band attachment system 40 includes a sewing head 41 which is placed on a mount 42 of work table 44, a garment puller 46 mounted adjacent and in operative relationship with respect to sewing head 41, spindles 12, 13, 14 and 15, shirt guide assembly 48 and garment ejector 50, which is partially hidden behind shirt guide assembly.

Figure 6:
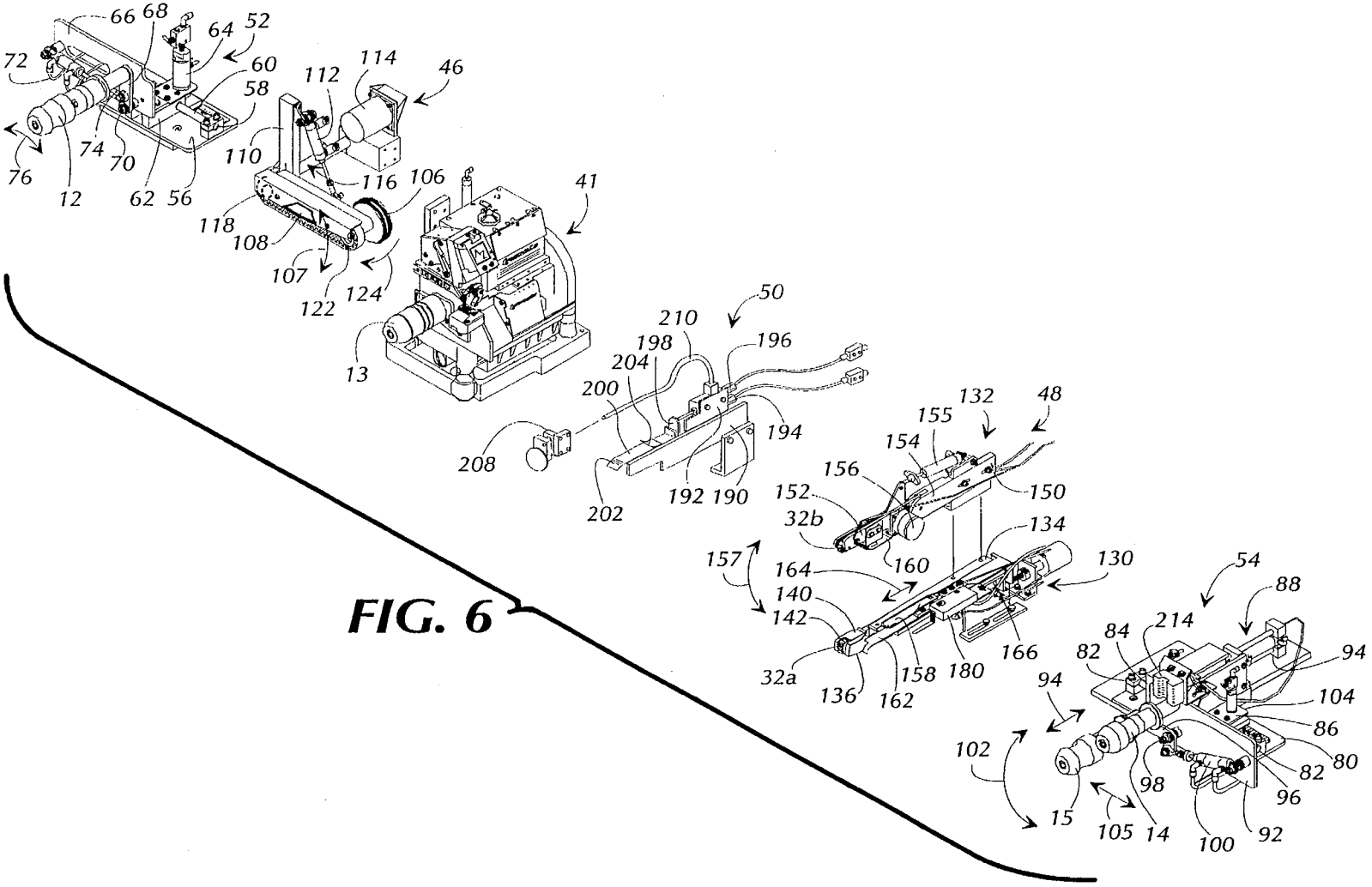
FIG. 6 is an expanded perspective illustration of the major components of the system.

FIG. 5 shows sewing head 41, garment puller 46, shirt guide assembly 48, garment ejector 50 and spindles 12–14 in side elevation. FIG. 6 shows these same components of the system in more detail.

As shown to the left of FIG. 6, spindle assembly 52 includes a mounting plate 56 that is attached to the work table 44, slide bar mounts 58 (only one shown) attached to mounting plate 56, slide bar 60 supported at its ends by slide bar mounts 58, and slide block 62 mounted on and movable along slide bar 60. Pneumatically actuated cylinder 64 is carried by the slide block 62, and its piston rod is movable into locking engagement with mounting plate 56, so as to hold slide block 62 in static relationship with respect to the mounting plate 56. Alternatively, the cylinder 64 can be activated with compressed air so as to withdraw its piston rod from mounting plate 56, whereupon slide block 62 will be movable along the length of slide bar 60. This enables the spindle 12 to be moved toward and away from sewing head 41 for the purpose of size adjustment with respect to larger and smaller of the garment parts.

Upright support plate 66 is mounted to slide block 62 by an L-shaped bracket (not shown), and spindle 12 is rotatably mounted to the upright support plate through pivot arm 68. Pivot arm 68 is mounted by pivot pin 70 to upright support plate 66, and spindle 12 is mounted to the other end of pivot arm 68. Pneumatically actuated cylinder 72 is mounted to upright support plate 66, and its piston rod 74 is mounted to pivot arm 68 between the pivot pin 70 and spindle 12. When cylinder 72 is actuated, spindle 12 will move through an arcuate path as indicated by double-headed arrow 76, generally toward and away from sewing head 41.

Spindle assembly 54 at the right side of FIG. 6, which is on the other side of sewing head 41 from spindle assembly 52, includes support plate 80 having slide bar mounts 82 supported on plate 80, and a slide bar 84 supported at its ends by the slide bar mounts. Slide block 86 is mounted on and movable along the length of slide bar 84, similar to the arrangement of spindle assembly 52. However, in order to provide spindles 14 and 15 with the ability to move transverse to the sewing path of sewing head 41, guide cylinder assembly 88 is mounted to and supported by slide block 86. The piston of guide cylinder 90 is attached to and controls the position of upright support plate 92 with respect to the sewing path 18 of the sewing head 41. Upper spindle 14 is mounted directly to the upright support plate 92, is rotatable about its longitudinal axis, and is movable in the direction as indicated by double-headed arrow 94 upon actuation of cylinder 90. L-shaped pivot arm 96 is attached at 98 to upright support plate 92 and lower spindle 15 is mounted to an end of pivot arm 96 and is rotatable about its longitudinal axis. Pneumatically actuated cylinder 100 is mounted to the upright support plate and is connected to the other end of pivot arm 96. When cylinder 100 is actuated, spindle 15 will move back and forth through an arc as indicated by double-headed arrow 102, generally toward and away from sewing head 41. Therefore, both spindles 14 and 15 are movable across the sewing path and spindle 15 is also movable toward and away from the sewing head 41.

Like spindle assembly 52, spindle assembly 54 includes pneumatically actuated cylinder 104 which is mounted to slide block 86 and which, when distended, engages and clamps against support plate 80. This locks the slide block in place on the support plate 80. However, when the positions of spindles 14 and 15 are to be moved closer to or farther away from sewing head 41, cylinder 104 is actuated to lift its piston rod (not shown) away from and out of locking relationship with respect to support plate 80, whereupon the slide block can be moved along its slide bar 84, thereby adjusting the distance from spindles 14 and 15 with respect to sewing head 41, to accept smaller or larger sized garments, as indicated by arrow 105.

Sewing head 41 (FIG. 6) includes an idler spindle 13 which extends below and laterally with respect to the sewing path of the system. Garment puller 46 is mounted above the sewing path 18 so that its puller wheel 106 moves downwardly toward and upwardly away from engagement with respect to spindle 13, as indicated by double-headed arrow 107. Puller wheel 106 is mounted to the distal end of pivot arm 108, and pivot arm 108 is pivotally mounted at its other end to upright support arm 110. Pneumatically actuated cylinder 112 which extends between the upper end of support arm 110 and the distal end of pivot arm 108 controls the arcuate movement of pivot arm 108. Stepping motor 114 includes a drive shaft that extends through tubular housing 116 and is connected to a sprocket 118 at the base of pivot arm 108. Sprocket 118 drives the timing belt 120, which in turn drives the sprocket 122 which is connected to puller wheel 106, causing the puller wheel to rotate in the clockwise direction as indicated by arrow 124. Spindle 13 of sewing head 41 is approximately cylindrical and is an idler spindle, in that it is not positively rotated by the motion of sewing head 41. Therefore, when puller wheel 106 is moved down into engagement with spindle 13, and puller wheel is rotated as indicated by arrow 124, spindle 13 will rotate in response to and in unison with the rotary movement of puller wheel 106.

As further illustrated in FIGS. 6, 7, 8A and 8B shirt guide assembly 48 includes lower and upper operative units 130 and 132, with the lower operative unit mounted to the work table and the upper operative unit mounted to the lower operative unit. Lower operative unit 130 includes a stationery support arm 134 that extends out beneath the sewing path of the sewing head 41 and supports at its distal end a star wheel support bracket 136. Lower star wheel 32A is rotatably mounted to star wheel support bracket 136 in a position so that it protrudes upwardly above bracket 136 and engages the shirt of the work product being processed through the sewing head. The length of stationary support arm 34 is sufficient so that the lower star wheel 32A reaches beyond the waist band 16 (FIG. 3) so as to engage only the upper run of the shirt body that is being processed through the system.

Photoelectric cell 138, which corresponds to photocell 30 schematically illustrated in FIG. 3, is mounted in a stationary position on star wheel support bracket 136 and reflective guide plate 140 is mounted to star wheel support bracket 136 in alignment with photocell 138. Reflective guide plate 140 includes a slot 142 which straddles lower star wheel 32A, but which is spaced above and generally parallel to stationary support arm 134 and star wheel support bracket 136, leaving a gap 144 (FIG. 7) between reflective guide plate 140 and star wheel support bracket 136 for the passage therebetween of the folded edge 21 of the waist band 16. Photocell 138 is positioned so as to detect the presence or absence of the folded edge portion 21 of the waist band in the gap 144 between the star wheel support bracket 136 and reflective guide plate 140. In response to the presence or absence of the folded edge 21 at photocell 138, the guide cylinder 90 of spindle assembly 54 operates to move spindles 14 and 15 in the directions as indicated by double-headed arrow 94, across the sewing path. This brings the aligned edges 19 and 20 of the folded waist band 16 in alignment with the sewing path of the sewing head 41.

The upper operative unit 132 of the shirt guide assembly 48 (FIGS. 6, 7 and 8B) includes a stationary support arm 150 that is mounted to the stationary support arm 134 of the lower operative unit 130. A pivot arm 152 is mounted at its base end by means of a pivot connection 154 to stationary support arm 150, and carries at its other end the upper star wheel 32B. Pneumatically actuated cylinder 155 is mounted between pivot arm 152 and stationary support arm 150 so as to move upper star wheel 32B in an arc toward and away from engagement with lower star wheel 32A, as indicated by double-headed arrow 157 in FIGS. 6 and 7.

Stepping motor 156 is mounted to pivot arm 152 and drives upper star wheel 32A by the means of a timing belt (not shown) within pivot arm 152.

Star wheels 32A and 32B have large gaps between their radially extending rounded edge teeth so that the shirt body 17 (FIG. 7) can move transverse to the star wheels in lightly sliding engagement with respect to the teeth of the star wheels. With this arrangement, the star wheels 32A and 32B reach beyond the waist band 16 (FIG. 7) to lightly engage the shirt body 17, and rotation of the upper star wheel 32B by motor 156 tends to pull the shirt body 17 into or out of the sewing path, so that the waist edge 23 of the shirt body 17 is aligned with the sewing path.

Photocell 208 is supported by its support arm 210 in a position to detect the edge 23 of the shirt body 17 moving laterally into and out of the sewing path as the edge travels between shirt guide assembly 48 and garment ejector 50. Upon the detection by photocell 208 of the edge of the shirt body being out of or in the sewing path, stepping motor 156 of shirt guide assembly 48 is actuated, to rotate the upper star wheel 32B either counterclockwise or clockwise, to move the edge 23 of the shirt body 17 into or out of the sewing path.

As shown in FIGS. 6, 7, 8A, 8B and 9, lower and upper decurler plates 158 and 160 are mounted on the stationary support arm 134 of lower operative unit 130 and the pivot arm 152 of the upper operative unit 132, respectively. Lower decurler plate 158 is elongated and substantially flat, and extends across the sewing path of sewing head 41 at a level between the waist band 16 that travels beneath the decurler plate and the shirt body 17 that travels over the decurler plate. Lower spacer plate 162 is mounted parallel to lower decurler plate 158, beneath lower decurler plate 158. Lower decurler plate and lower spacer plate 158 and 162 are movable as indicated by double-headed arrow 164 (FIG. 7) laterally with respect to the sewing path, out into the sewing path and then retracted away from the sewing path. Pneumatically operated cylinder 166 (FIGS. 6 and 8A) functions to move the decurler plate 158 and its lower spacer plate 162, as described.

Figure 7:
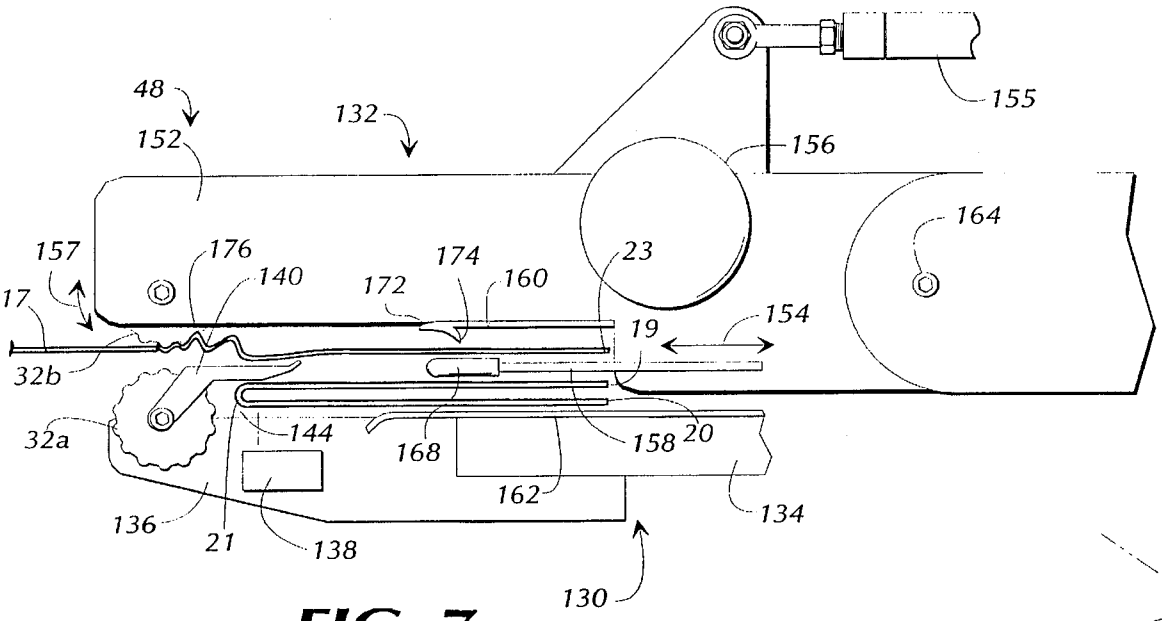
FIG. 7 is a side elevational view of the shirt guide system and the decurler.

Air supply tube 168 (FIG. 9) extends around the distal end of lower decurler plate 158, and has its open end 170 facing across the sewing path toward the anticipated position of the edge 23 of the shirt body 17 (FIG. 7). Air is expelled through the air supply tube, out of its open end 170, so as to flow across the lower surface of the shirt body 17, and then beyond the edge 23 of the shirt body.

In a similar manner, upper decurler plate 160 (FIGS. 7 and 9) has an air supply tube 172 mounted thereto, with its open end 174 directed at a sloped angle toward shirt body 17, toward the anticipated position of the edge 23 of the shirt body. Therefore, when pivot arm 152 is moved down by its cylinder 154 so that star wheels 32A and 32B are closely spaced for engaging the shirt body 17 (FIG. 7), air expelled from lower and upper decurler plates 158 and 160 will flow in generally parallel paths across the lower and upper surfaces of the shirt body 17, toward the edge 23 of the shirt body, thereby tending to remove any curl that might be formed in the edge portion of the shirt body due to the stretching of the shirt body during the sewing process. There may be a tendency of the shirt body 17 to momentarily bunch just inside the star wheels, as indicated at 156 when the star wheels abruptly urge the shirt body into the sewing path. However, the flow of air from the lower and upper decurler plates 158 and 160 tends to urge the shirt body 17 across the sewing path, from left to right in FIG. 7, thereby tending to remove the bunching 156 that might be momentarily caused by the lower and upper star wheels 32A and 32B when urging the shirt body into the sewing path. This makes the rotation of the star wheels effective to "push" the shirt material from left to right (FIG. 7) when the upper star wheel 32B is rotated in a counterclockwise direction. When the upper star wheel 32B is rotated in a clockwise direction, its rotational movement is sufficient to pull the shirt body from right to left (FIG. 7), so as to pull the edge 23 of the shirt body out of the sewing path.

Figure 10:
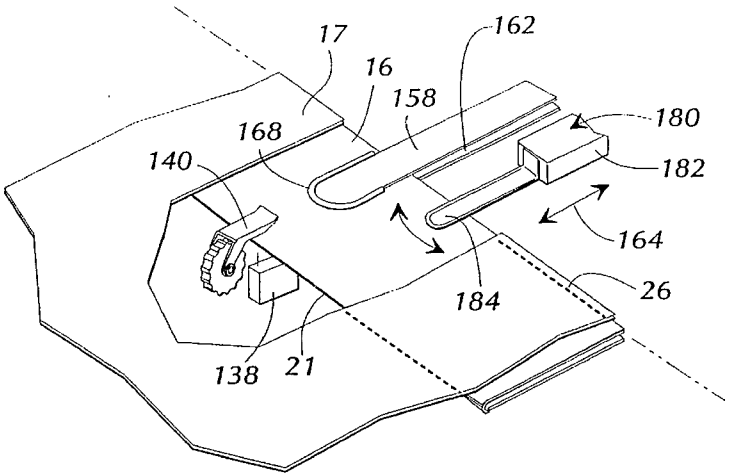
FIG. 10 is a perspective illustration of a portion of the decurler and of the lever switch, illustrating how the garment parts move adjacent thereto.
Figure 9:
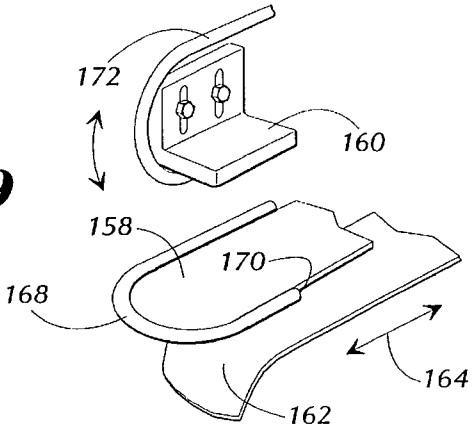
FIG. 9 is a perspective illustration of portions of the decurler and of the lever switch..
Figure 8A:
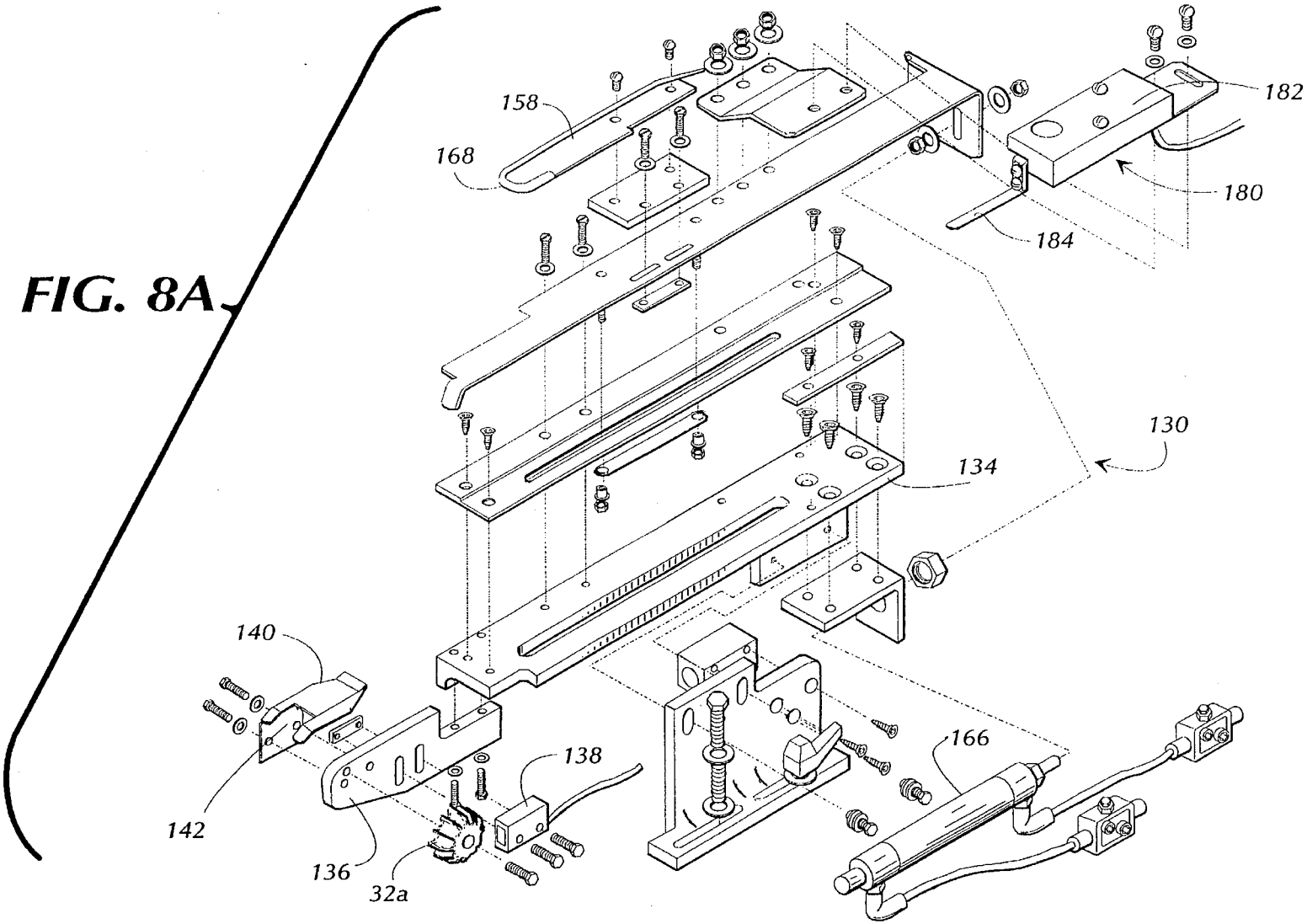
FIG. 8A is an expanded perspective illustration of the lower unit of the shirt guide assembly.
Figure 8B:
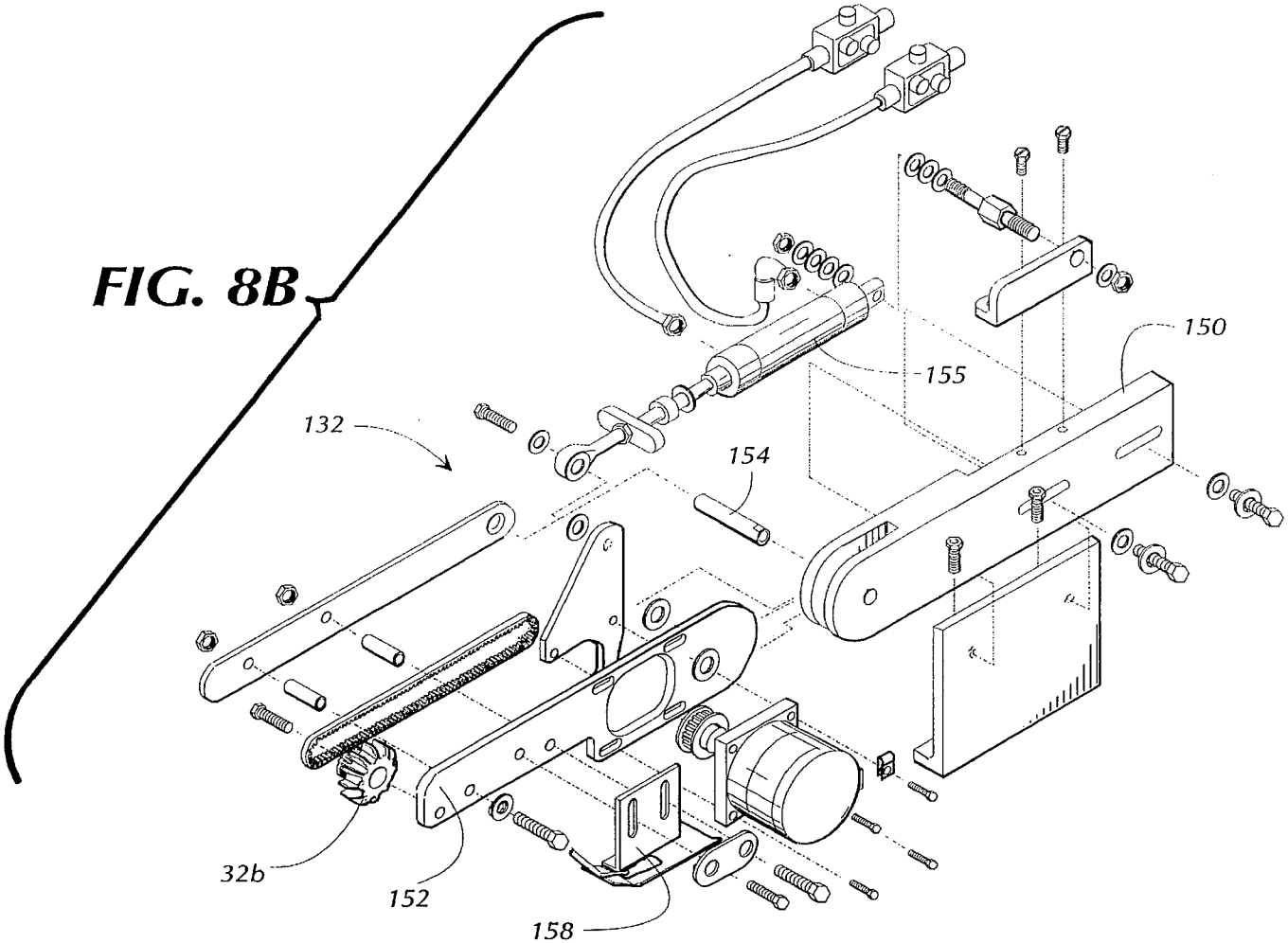
FIG. 8B is an exploded perspective illustration of the upper unit of the shirt guide assembly.

As illustrated in FIGS. 6, 9 and 10, lever switch 180 is supported on lower operative unit. 130 of shirt guide assembly 48, and is movable across the sewing path in unison with lower decurler plate 158 by cylinder 166. Lever switch 180 includes a switch housing 182 and lever 184 which protrudes from switch housing 182. When cylinder 166 moves lower decurler plate 158 and lower spacer plate 162 out into the sewing path, the cylinder simultaneously moves the lever switch 180 so that its lever 184 also moves out into the sewing path, at the same level as lower decurler plate 158. This places the lever 184 and lower decurler plate 158 between the plies of material, on top of the folded waist band 16 and below the shirt body 17. With this arrangement, when the plies of material are being sewn together and the previously sewn portion as represented by the line of stitching 26 (FIG. 10) approaches and engages lever 184 of lever switch 180, the lever 184 is deflected and actuates its switch. This causes cylinder 166 of the shirt guide assembly 48 to retract lever switch 180, lower decurler plate 158 and lower spacer plate 162 out of the sewing path so as to permit the stitching 26 to pass on beyond the shirt guide assembly 48.

As illustrated in FIG. 6, garment ejector 50 includes a support plate 190 that is mounted to the work table 44. Support housing 192 is mounted over support plate 190 and accommodates lower and upper actuating cylinders 194 and 196. Upper cylinder 196 is connected to pusher fork 198, and lower cylinder 194 is connected to ejector plate 200. Ejector plate 200 includes a lower plate 202 with a downwardly turned distal end, and an upper plate 204 that is spaced from lower plate 202 and includes an upwardly turned distal end. Lower cylinder 194 is longer than and has a longer stroke than upper cylinder 196. The ejector plate 200 is shown in its retracted position. When upper cylinder 196 is actuated, its fork 198, which straddles the piston rod of lower cylinder 194, pushes the ejector plate 200 outwardly into the sewing path. This moves the lower plate 202 beneath both layers of material and the upper plate 204 above both layers of material and aligns the bite between the lower and upper plates 202 and 204 with the sewing path. When lower cylinder 194 is actuated, it pushes ejector plate 200 farther beyond pusher fork 198, beyond the sewing path of the sewing head 41. Since the garment ejector 50 is the attachment that is immediately upstream of the sewing head 41, the actuation of the lower cylinder 194 and the movement of the ejector on beyond the sewing path causes the work product to be pushed out of the sewing path. This results in the sewing machine sewing off the edge of the garment part.

When both cylinders 194 and 196 are retracted, the ejector 50 is completely retracted out of the way of the garment parts. This allows the operator of the system to load the garment parts on the spindles without obstruction by the ejector.

In order to place the system in operation, a thumb swipe switch 214 is mounted on upright support plate 92 of spindle assembly 54, just above and to the right of upper right hand spindle 14. This allows the operator of the system to stretch the garment parts about the spindles 12–15 and with only a small movement, the operator can move her thumb through the recess of the thumb swipe switch, and the system will begin its automatic operation.

Figure 12:
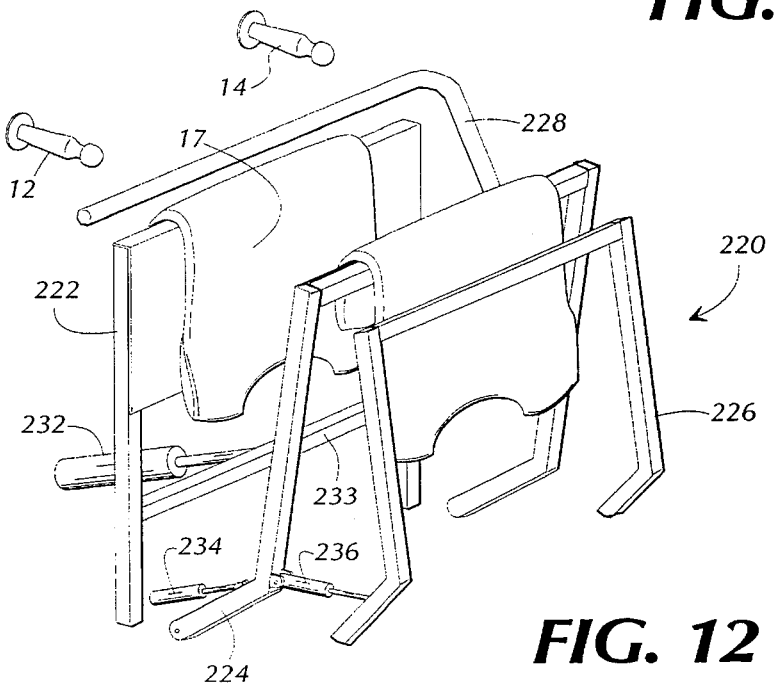
FIGS. 12–16 are perspective, progressive illustrations of the stacker, showing how the stacker functions at the end of the cycle of the sewing head.

FIGS. 4 and 12 illustrate the stacker 220 that is placed adjacent the work table 44, which is used by the system operator to retrieve shirt bodies for placement on the spindles 12–15, and which automatically removes the completed work product after the sewing cycle has been completed.

As illustrated in FIG. 12, stacker 220 includes supply frame 222, accumulator frame 224, clamp frame 226 and wiper bar 228. As illustrated in FIG. 4, the supply frame, accumulator frame and clamp frame are all pivotally mounted at their lower ends on a common support 230. The position of supply frame 222 is controlled by cylinder 232 which is mounted to a stationary support and is connected to the cross bar 233 of the frame. Likewise, the position of accumulator frame 224 is controlled by its cylinders 234 (only one shown) which are mounted on a stationary support and are connected to the accumulator frame. Clamp frame 226 generally moves in unison with accumulator frame 224, except when its cylinder 236 is actuated. Cylinder 236 is mounted to accumulator frame 224 and is connected to clamp frame 226.

Wiper bar 228 is also actuated by a pneumatic cylinder (not shown) in housing 240 (FIG. 4).

Figure 13:
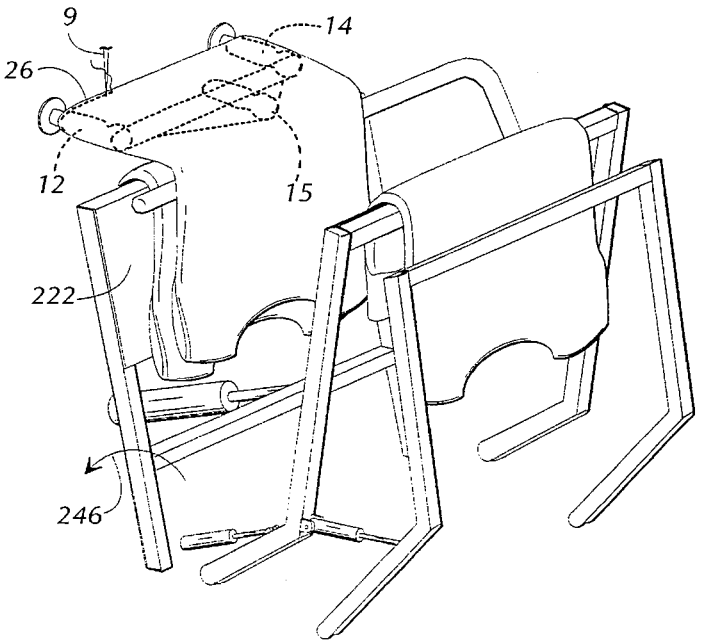
Figure 14:
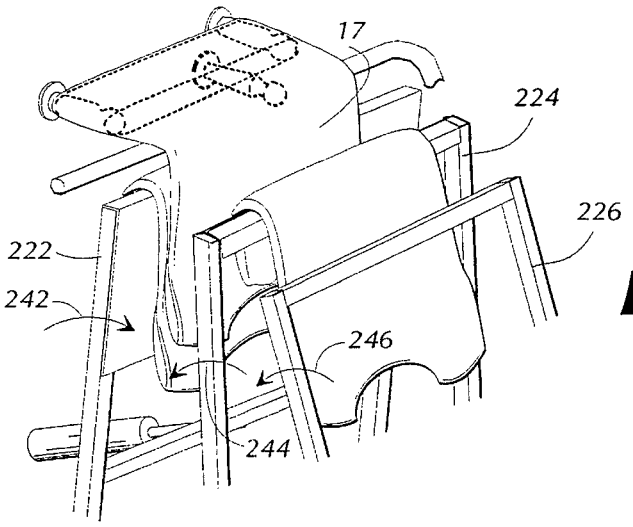

FIG. 12 illustrates the positions of the frames 222, 224 and 226 and wiper bar 228 when the operator is ready to begin the cycle of the system. The operator folds a waist band as indicated in FIGS. 1 and 2 so that its edges are in overlying alignment and inserts the waistband about the spindles 12–15. The operator then retrieves a shirt body 17 from the supply of shirt bodies resting in folded over relationship at the top of supply frame 222. The shirt body is then lifted and inserted over the wiper bar 228 and on to the spindles 12–15, as illustrated in FIG. 3. When the operator actuates the cycle of the system by passing her thumb through the switch 214, the supply frame 222 is moved by its cylinder 232 in the direction as indicated by arrow 240 (FIG. 13), in an out of the way position. The system continues to operate to form the stitching 26 until the garment parts are completed.

At the completion of the garment parts, all three of the frames 222, 224, and 226 move as indicated by arrows 242, 244, and 246 to clamp against the trailing portion of the shirt body 17.

Figure 15:
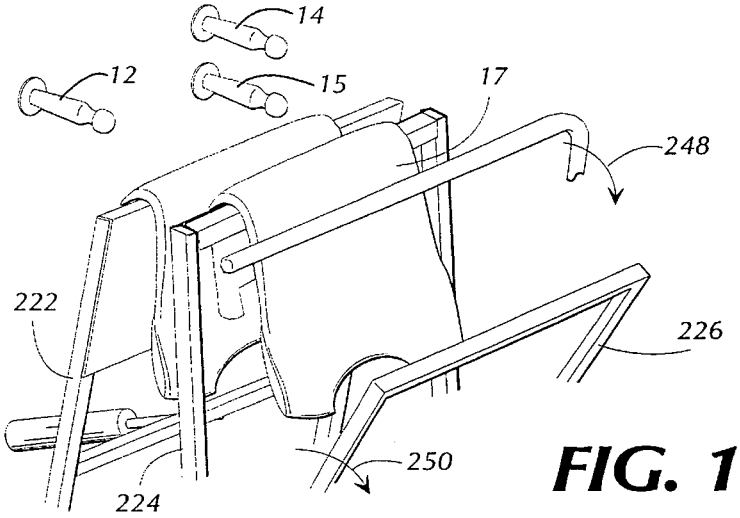
Figure 16:
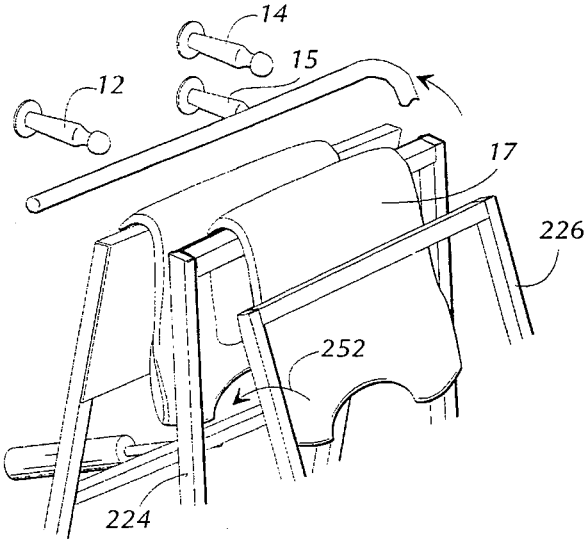

With the shirt body clamped between the frames 222, 224 and 226, the wiper bar 228 begins its movement (FIG. 15) as indicated by arrow 248, and clamp frame 226, at the same time, begins its movement away from its clamping position, as indicated by arrow 250. This causes the shirt body 17 to be flipped over the accumulator frame 224.

Once the shirt body has been flipped over the accumulator frame 224, the clamp frame 226 returns into clamping relationship with respect to accumulator frame 224 as indicated by arrow 252. Once the clamp frame 226 has achieved clamping relationship with respect to the shirt body 17 and accumulator frame 224, the clamp frame and accumulator frame pivot back to their out of the way positions as indicated in FIG. 12.

As illustrated in FIG. 4, a stationary accumulator rail 260 extends from adjacent the stacker 220 out to a lateral position beside the system. When a bunch of completed garment parts 17 have been accumulated on accumulator frame 224, the operator can simply slide the accumulated bunch laterally off the accumulator frame 224 and onto the aligned accumulator rail 260, where the bunch can be retrieved by the operator and placed on a rolling trolley, etc. for subsequent processing.

OPERATION

Figure 17:
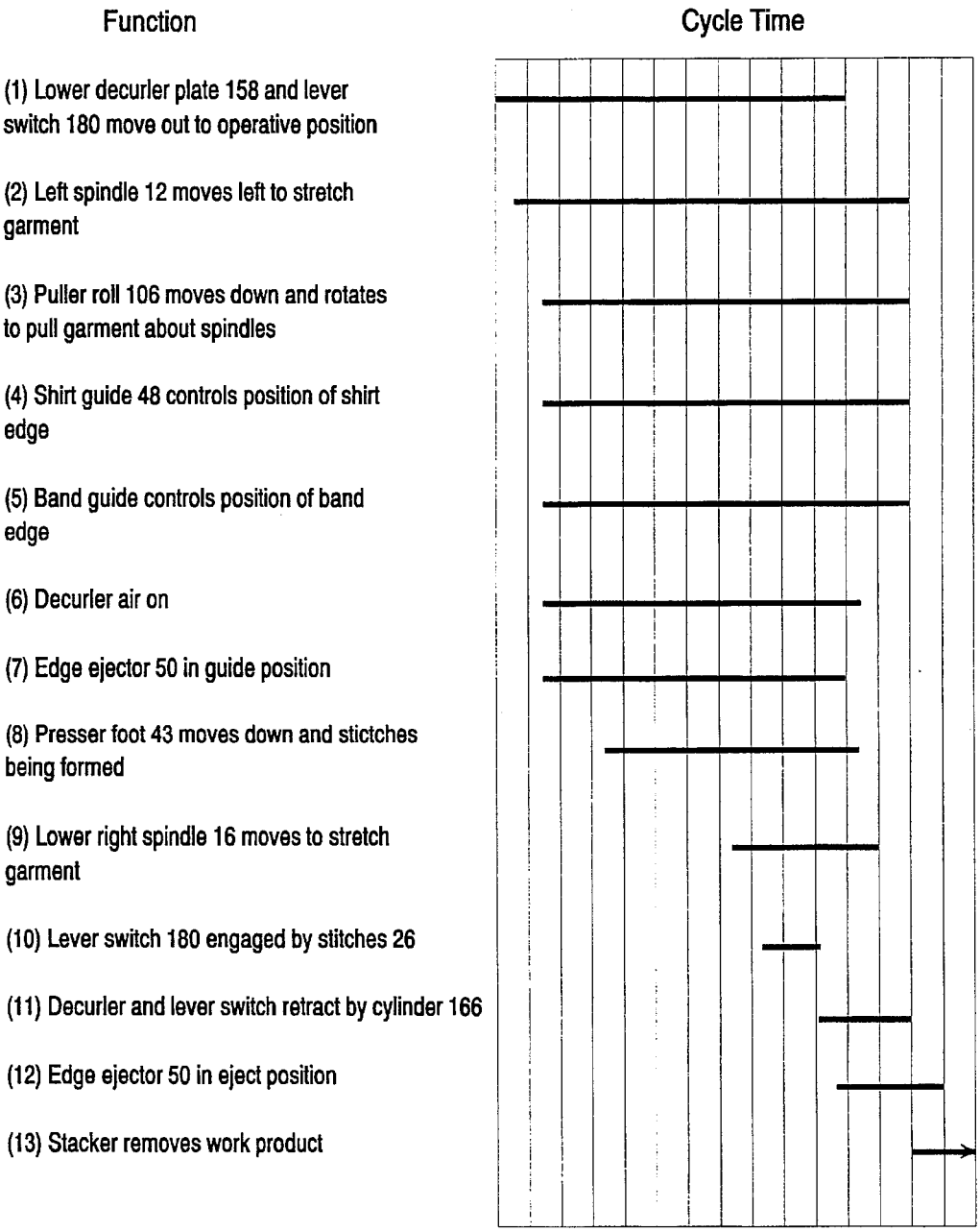
FIG. 17 is a schematic illustration of the cycle time for the major functions of the system.

FIG. 17 provides a schematic illustration of the cycle time of the waist band attachment system.

Function 1: When the operator loads the waist band 16 on the system, by stretching the waist band about the spindles 12–15, the waist band covers photocell 138 (FIG. 7). This causes lower decurler plate 158, lower spacer plate 162 and lever switch 180 to move out into the sewing path (FIGS. 9 and 10). The decurler plate and lever 184 of the lever switch will move out over the waist band 16 (FIG. 10), while the spacer plate 162 moves out beneath the waist band. In order to properly place the waist band 16 in position, the operator must move the waist band beyond the reflective guide plate 140 of the lower operative unit 130 of the shirt guide assembly 48, and then bring the folded edge 21 back beneath the reflector plate 140 so as to break the beam of photocell 138.

Once the waist band has been properly placed as described, the operator then retrieves the waist edge of a garment 17 from the stacker (FIGS. 12–16) and mounts the waist edge of the shirt body about the spindles (FIG. 3). Once the shirt body is in place about the spindles, the operator actuates the start switch 214, and the system begins its cycle of operation.

Function 2: At the beginning of the cycle of operations the left spindle 12 moves left to stretch the garment. This causes the waist edge of the shirt body and the waist band to be stretched to substantially the same breadth.

Functions 3, 4, 5, 6 and 7 are then actuated simultaneously.

Function 3: Puller roll 106 (FIG. 6) moves down and rotates against the spindle 13 of the sewing head 41 to clamp the garment parts against the spindle and to pull the garment parts about the rotatable spindles 12–15.

Function 4: Shirt guide assembly 48 controls the position of the shirt edge, by the photocell 208 determining the edge of the waist being in or out of the sewing path, causing the star wheels 32A and 32B to rotate to urge the shirt edge back to its proper position.

Function 5: Photocell 138 at the lower operative unit 130 of the shirt guide assembly detects the location of the fold 21 of the waist band (FIG. 7), and cylinder 90 of spindle assembly 54 urges spindles 14 and 15 laterally with respect to the sewing path as indicated by arrow 94 so as to align the fold of the waist band with respect to the photocell 138.

Function 6: Air is supplied to lower decurler plate 158 and upper decurler plate 160, to remove the curl from the stretched edge of the shirt body.

Function 7: Garment edge ejector 50 is moved outwardly to its guide position. The lower and upper plates 202 and 204 (FIG. 6) straddle both garment parts and the narrow spacing between the lower and upper plates assures that any tendency of the waist edge of a shirt body to curl is retarded as the garment parts move from the shirt guide assembly 48 to the sewing head 41.

Function 8: The system is allowed to operate for a predetermined time before sewing head 41 if actuated. This allows any previously curled portion of the waist edge of a shirt body to pass on through the sewing head, until the flattened portion of the waist edge passes from the shirt guide assembly 48 through garment ejector 50 and to sewing head 41. At this point, presser foot 43 moves down into contact with the garment parts and the sewing needle begins its sewing function.

Figure 11:
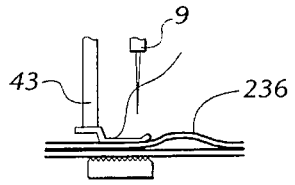
FIG. 11 is a side elevational view of the presser foot, feed dogs and needle of the sewing machine, showing how bunching of the top ply of material can occur just prior to the previously stitched portion of the work product reaching the presser foot if the garment is not stretched just prior to the end of the sewing cycle.

Function 9: The system is permitted to operate for a predetermined stitch count. Once the stitch count has been achieved, the lower right spindle 16 moves outwardly to stretch the garment parts further. This function is desirable so as to avoid the formation of a wrinkle or pleat 263 (FIG. 11) just prior to the position of the presser foot 43. With the garment stretched further as the previously sewn portion of the garment begins its approach to the sewing needle 9, the pleat 236 tends to disappear.

Function 10: As the previously stitched portion of the garment (FIG. 10) approaches the sewing head, the lever 184 of lever switch 180, which protrudes between the plies of material, will be engaged by the first stitches 26, causing the lever to be deflected and causing switch 180 to be activated.

Function 11: When lever switch 180 has been deflected, cylinder 166 retracts lower decurler plate 158, lower spacer plate 162 and lever switch 180 out of the path of the oncoming stitches.

Function 12: After a predetermined stitch count beyond the time of deflection of the lever switch 180, edge ejector 50 is pushed across the sewing path by the longer of its cylinders 194. This causes the edges of the garment parts to move out of the sewing path, so that the sewing head 41 sews off of the garment parts.

Function 13: Stacker 220 (FIGS. 12–16) begins its stacking function, as previously described.

Once the sewing head has sewn off of the work product, the system is de-energized, so that the spindles 12 and 15 retract to their original positions close to the sewing head, garment ejector 50 retracts to its out of the way position, as does lower decurler plate 158, lower spacer plate 162 and lever switch 180. The system is now ready for a second cycle.

It will be understood that the foregoing relates only to a preferred embodiment of the present invention, and it is anticipated that numerous changes and modifications may be made therein without departing from the spirit and scope of the invention as set forth in the following claims.

We claim:

1. A method of attaching an uninterrupted looped waist band to the uninterrupted waist edge of a shirt body comprising the steps of:

placing the waist edge of the shirt body in surrounding overlying relationship with respect to an edge of the waist band in substantially edge-to-edge alignment with the edge of the waist band, stretching the overlaid portions of the edge of the shirt body and waist band until they are in tension, advancing the aligned edges of the waist band and the shirt body along their lengths while under tension through a sewing station and forming stitches in the waist band and shirt body at the aligned edges to connect them together, as the stitched portion of the waist band and shirt body approach the sewing station, further stretching the overlaid portions of the shirt body and waist band that are approaching the sewing station to remove any wrinkles in the shirt body at the sewing station.

2. The method of claim 1 and wherein the step of overlaying the waist band edge of the shirt body with the waist band in edge-to-edge alignment with an edge of the waist band comprises:

arranging the waist band in straddling relationship about a plurality of support spindles and telescoping the waist band edge of the shirt body about the waist band.

3. The method of claim 2 and wherein the step of stretching the overlaid portions of the waist band and shirt body until they are in tension comprises:

moving the spindles away from one another.

4. The method of claim 3 and wherein the step of advancing the aligned edges of the waist band and the shirt body while under tension through a sewing station comprises:

rotating at least one of the support spindles to advance the work product through the sewing needle assembly of a sewing machine.

5. The method of claim 1 and further including the step of relieving the tension from the waist band and shirt body after completing the stitch formation.

6. The method of claim 2 and wherein the step of arranging the waist band in straddling relationship about a plurality of support spindles and telescoping the edge of the shirt body about the waist band comprises:

moving the waist band and shirt body into abutment with a radially extending flange on at least some of said support spindles.

7. The method of claim 1 and further including the step of removing the curl in the aligned edges of the shirt body and the waist band as the aligned edges approach the sewing station.

8. The method of claim 7 and wherein the step of removing the curl in the aligned edges of the shirt body and the waist band comprises directing a flow of air across the edges as the edges are advanced toward the sewing station.

9. The method of claim 7 and wherein the step of forming stitches in the waist band is initiated after the initiation of the step of removing the curl.

10. The method of claim 1 and further including the step of progressively aligning the waist edge of the shirt body with the sewing path of a sewing machine at the sewing station.

11. The method of claim 1 and further including the step of progressively aligning the edge of the waist band with the sewing path of a sewing machine at the sewing station.

12. The method of claim 1 and wherein the step of overlaying the waist edge of the shirt body with respect to an edge of the waist band comprises:

placing the waist band about a plurality of support spindles, with an edge of the waist band aligned with the sewing path of a sewing machine in the sewing station, placing the waist edge of the shirt body about the same plurality of support spindles aligned with the sewing path, wherein the step of stretching the overlaid portions of the shirt body and the waist band comprises moving at least one spindle of the plurality of spindles, and wherein the step of further stretching the overlaid portions of the shirt body and waist band comprises moving at least one spindle of the plurality of spindles.

13. A method of attaching an uninterrupted loop waist band to the waist edge of a shirt body of an approximately tubular garment comprising the steps of:

placing the waist band about a plurality of support spindles with an edge of the waist band aligned with the sewing path of a sewing machine, placing the waist edge of the shirt body of the garment about the waist band with the edge of the shirt body substantially matched with the edge of the waist band and aligned with the sewing path, advancing the waist band and the waist edge of the shirt body along the sewing path, removing any curl in the edge of the shirt body and the edge of the waist band at a position along the sewing path upstream of the sewing needles of the sewing machine as the waist band and shirt body move toward the sewing needles of the sewing machine, after the portion of the waist band and waist edge of the shirt body which have the curl removed therefrom have reached the needles of the sewing machine, initiating the sewing function of the sewing machine to connect the uncurled and matched edges of the waist band and shirt body together, and as the waist band and the waist edge of the shirt body are advanced along the sewing path, engaging the shirt body with wheel means and rotating the wheel means to urge the waist edge across the sewing path toward alignment with the sewing path.

14. The method of attaching a waist band to the waist edge of a shirt body of a garment as set forth in claim 13 and further comprising the step of:

expanding the waist band and waist edge of the shirt body until both the waist band and waist edge of the shirt body are under tension.

15. The method of attaching a waist band to the waist edge of a shirt body of a garment as set forth in claim 13 and wherein the step of removing any curl in the edge of the shirt body and the edge of the waist band comprises:

passing the waist band and the waist edge of the shirt body on opposite sides of a separator plate, and directing streams of air against the waist band and shirt body as the waist band and shirt body traverse the separator plate in directions that induce any curl in the matched edges of the waist band waist edge of the shirt body to be removed.

16. A process of connecting edges of curled edge plies of tubular material comprising the steps of:

placing an edge portion of one ply of material beneath a separator plate in alignment with the sewing path of a sewing machine, placing an edge portion of a second ply of material over the separator plate and in alignment with the sewing path of the sewing machine with the edge portions of the plies of material laterally matched with each other and in contact with each other on opposite sides of the separator plate, advancing the edge portions of the plies of material about the separator plate and through the sewing path of the sewing machine, uncurling any curl in the plies of material at the separator plate as the plies of material pass about the separator plate and toward the sewing machine, initiating the sewing together of the edge portions of the plies of material after the plies of material have been uncurled, and as the edge portions of the plies of material are advanced through the sewing path, engaging at least one of the plies of material with wheel means and rotating the wheel means in a direction so that the wheel means urges the engaged ply of material toward alignment with the sewing path.

17. The process of claim 16 and further including the step of:

stretching the plies of material as they advance about the separator plate and through the sewing machine.

18. The process of claim 16 and further including the step of mounting the tubular plies of material in a straddling relationship about a plurality of spindles and revolving the plies of material about the spindles.

19. An attachment for a sewing machine for guiding a stretchable loop waist band and the waist of a tubular garment part to the sewing machine comprising:

spindle means for holding the edges to be connected of the waist band and the tubular garment in side-by-side matched relationship in the sewing path of the sewing machine, drive means for moving the matched edges along the sewing path through the sewing machine, decurling means positioned in the sewing path upstream of the sewing machine for removing curl from the matched edges of the waist band and the waist edge of the tubular garment as the matched edges move toward the sewing machine, means for actuating the sewing function of the sewing machine to sew the matched edges together only after the matched edges of the waist band and tubular garment part have been decurled by the decurling means and have been moved to the sewing machine, and guide star wheels positioned adjacent the sewing path for engaging and moving the tubular garment across the sewing path to align the waist edge of the tubular garment with the sewing path.

20. The attachment for a sewing machine as set forth in claim 19 and further including means for removing said decurling means from the sewing path of the sewing machine as the first portion of the matched edges of the waist band and the tubular garment which have been sewn together return to the sewing machine.

21. The attachment for a sewing machine as set forth in claim 19 and further including means for stretching the waist band and the waist edge of the tubular garment to substantially the same breadth as the matched edges are decurled and sewn together.

22. The attachment for a sewing machine as set forth in claim 19 and wherein said spindle mounting means comprises at least two spindles, a first of said spindles positioned upstream of the sewing machine for guiding the matched edges of the waist band and tubular garment part along the sewing path toward the sewing machine and the second of said spindles positioned down stream of the sewing machine for guiding the matched edges of the waist band and tubular garment part back toward the one spindle, each of said spindles including an elongated body, rounded at a distal end, a radially extending flange at its other end in alignment with the sewing path of the sewing machine, and a tapered portion converging toward said flange, so that the matched edges of the waist band and the waist edge of the tubular garment part are placed in straddling relationship about the spindles on the tapered portions of the spindles, and the tapered portions of the spindles assure that the matched edges remain in abutment with the flanges as the matched edges move about the spindles.

23. The attachment for a sewing machine of claim 19 and further including edge guide means positioned up stream of the sewing machine and between said decurler and the sewing machine, said guide means defining a slot sized to slidingly receive the matched edges of the waist band and tubular garment part as the matched edges move toward the sewing machine, means for moving the slot of said guide means between a first position withdrawn from the sewing path, a second position in the sewing path in which the slot of said guide means straddles and guides the matched edges toward the sewing machine, and a third position which guides the matched edges away from the sewing path.

* * * * *